US011176859B2

(12) United States Patent
Orio et al.

(10) Patent No.: US 11,176,859 B2
(45) Date of Patent: Nov. 16, 2021

(54) DEVICE AND METHOD FOR DISPLAY MODULE CALIBRATION

(71) Applicant: SYNAPTICS INCORPORATED, San Jose, CA (US)

(72) Inventors: Masao Orio, Tokyo (JP); Joseph Kurth Reynolds, San Jose, CA (US); Xi Chu, Fremont, CA (US); Takashi Nose, Tokyo (JP); Hirobumi Furihata, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/828,819

(22) Filed: Mar. 24, 2020

(65) Prior Publication Data

US 2021/0304649 A1 Sep. 30, 2021

(51) Int. Cl.
*G09G 3/00* (2006.01)
*G09G 3/3208* (2016.01)

(52) U.S. Cl.
CPC ..... *G09G 3/006* (2013.01); *G09G 3/3208* (2013.01); *G09G 2320/0626* (2013.01); *G09G 2320/0693* (2013.01)

(58) Field of Classification Search
CPC ..... G09G 3/006; G09G 3/3208; G09G 2320/0693; G09G 2320/0626
See application file for complete search history.

(56) References Cited

U.S. PATENT DOCUMENTS 4,568,975 A * 2/1986 Harshbarger ..... H04N 17/04 324/404
5,298,993 A * 3/1994 Edgar ..... H04N 17/00 348/180
5,754,222 A * 5/1998 Daly ..... G09G 5/02 348/184
6,546,121 B1 * 4/2003 Oda ..... G06K 9/00597 382/117
6,693,642 B1 * 2/2004 Ogawa ..... G09G 1/16 345/589
8,369,645 B2 * 2/2013 Harada ..... G06T 5/009 382/274
9,318,076 B2 * 4/2016 Kwak ..... G09G 5/10
(Continued)

FOREIGN PATENT DOCUMENTS

KR 20140129727 A 11/2014

OTHER PUBLICATIONS

International Search Report issued in corresponding international application No. PCT/US2021/020701 dated Jun. 24, 2021 (3 pages).
(Continued)

*Primary Examiner* — Amy Onyekaba
(74) *Attorney, Agent, or Firm* — Ferguson Braswell Fraser Kubasta PC

(57) ABSTRACT

A method comprises acquiring measured luminance levels at a measurement point of a display area for a plurality of test images displayed in the display area, and estimating one or more luminance levels at one or more corresponding luminance estimation points of the display area using the measured luminance levels. The method further comprises determining, based on the one or more estimated luminance levels, a correction parameter using the estimated one or more luminance levels.

9 Claims, 15 Drawing Sheets

(56) References Cited

U.S. PATENT DOCUMENTS 9,508,317 B2* 11/2016 Iwafuchi ..... H04N 21/4854
10,769,972 B2* 9/2020 Kim ..... G09G 3/006
2002/0097395 A1* 7/2002 Smith ..... G09G 3/006 356/239.2
2003/0183748 A1* 10/2003 Yamaguchi ..... H04N 17/04 250/208.1
2004/0196250 A1* 10/2004 Mehrotra ..... H04N 9/73 345/102
2005/0062710 A1* 3/2005 Kasai ..... G09G 3/3225 345/99
2005/0068291 A1* 3/2005 Coley ..... G09G 5/10 345/156
2005/0259092 A1* 11/2005 Aoki ..... G09G 3/3648 345/204
2005/0277815 A1* 12/2005 Taniguchi ..... A61B 6/582 600/300
2006/0028462 A1* 2/2006 Ono ..... A61B 6/461 345/204
2007/0001710 A1* 1/2007 Park ..... G09G 3/3611 324/750.19
2007/0052735 A1* 3/2007 Chou ..... G09G 3/2003 345/690
2007/0057975 A1* 3/2007 Oh ..... G09G 3/3648 345/690
2008/0055210 A1* 3/2008 Cok ..... G09G 3/006 345/77
2008/0191985 A1* 8/2008 Katayama ..... G09G 3/006 345/89
2008/0303766 A1* 12/2008 Lee ..... G09G 3/006 345/89
2010/0066850 A1* 3/2010 Wilson ..... H04N 17/04 348/222.1
2010/0079365 A1* 4/2010 Feng ..... G09G 3/3426 345/102
2010/0328355 A1* 12/2010 Fukushima ..... G09G 3/342 345/690
2011/0069051 A1* 3/2011 Nakamura ..... G09G 3/3233 345/207
2011/0148904 A1* 6/2011 Kotani ..... H04N 9/3179 345/589
2011/0279482 A1* 11/2011 Neal ..... G09G 3/3426 345/690
2011/0298763 A1* 12/2011 Mahajan ..... G09F 9/3026 345/207
2013/0135272 A1* 5/2013 Park ..... G09G 3/3233 345/211
2014/0176626 A1* 6/2014 Sasaki ..... G09G 3/2051 345/697
2014/0246982 A1* 9/2014 Araki ..... G09G 3/3406 315/151
2014/0333593 A1* 11/2014 Nagashima ..... G09G 3/3426 345/207
2014/0333660 A1* 11/2014 Ballestad ..... G06K 9/6202 345/593
2014/0333681 A1* 11/2014 Oh ..... G09G 3/20 345/690
2015/0124002 A1* 5/2015 Horikawa ..... G09G 3/3607 345/690
2015/0243249 A1* 8/2015 Nagashima ..... G09G 5/02 345/589
2016/0117987 A1* 4/2016 Byun ..... G09G 3/3266 345/205
2017/0025051 A1* 1/2017 Li ..... G09G 3/006
2017/0032742 A1* 2/2017 Piper ..... G09G 3/3233
2017/0076675 A1* 3/2017 Hatanaka ..... G09G 3/3648
2017/0110070 A1* 4/2017 Ikeda ..... G09G 3/36
2017/0162094 A1* 6/2017 Jee ..... G09G 3/3266
2017/0328703 A1* 11/2017 Dun ..... G01J 1/42
2018/0144716 A1* 5/2018 Jung ..... G09G 3/3208
2018/0190214 A1* 7/2018 Kim ..... G09G 3/3413
2019/0104294 A1* 4/2019 Qiu ..... H04N 5/2351
2019/0191153 A1* 6/2019 Speigle ..... G09G 5/10
2019/0304353 A1* 10/2019 Orio ..... G09G 3/2003
2020/0066215 A1* 2/2020 Koo ..... G09G 3/3607
2020/0135101 A1* 4/2020 Yamaguchi ..... G09G 3/3233
2020/0319593 A1* 10/2020 Nam ..... G03H 1/2294
2020/0365113 A1* 11/2020 Chen ..... G09G 5/02
2021/0158777 A1* 5/2021 Kim ..... G09G 5/10
2021/0166612 A1* 6/2021 Lee ..... G09G 3/035

OTHER PUBLICATIONS

Written Opinion of the International Searching Authority issued in corresponding international application No. PCT/US2021/020701 dated Jun. 24, 2021 (4 pages).

* cited by examiner

DEVICE AND METHOD FOR DISPLAY MODULE CALIBRATION

BACKGROUND

Field

Embodiments disclosed herein relate to a device and method for display module calibration.

Description of the Related Art

An image displayed on a display panel may experience display mura caused by a voltage drop (which may also be referred to as IR drop) over a power source line of a display panel. A display module may be calibrated to reduce the display mura.

SUMMARY

This Summary is provided to introduce in a simplified form a selection of concepts that are further described below in the Detailed Description. This Summary is not intended to identify key features or essential features of the claimed subject matter, nor is it intended to limit the scope of the claimed subject matter.

A method for display module calibration is disclosed. In one or more embodiments, a method comprises acquiring measured luminance levels at a measurement point of a display panel area for a plurality of test images displayed on the display area and estimating one or more luminance levels at one or more corresponding luminance estimation points of the display area using the measured luminance levels. The method further comprises determining a correction parameter using the estimated one or more luminance levels.

In one or more embodiments, a device for display module calibration is disclosed. The calibration device comprises a luminance meter and a processing unit. The luminance meter is configured to measure luminance levels at a measurement point of a display area for a plurality of test images displayed in the display area. The processing unit is configured to estimate one or more luminance levels at one or more luminance estimation points of the display area using the measured luminance levels. The processing unit is further configured to determine a correction parameter using the one or more estimated luminance levels.

A non-transitory tangible storage medium is also disclosed. In one or more embodiments, a non-transitory tangible storage medium stores a program. The program, when executed, causes a processing unit to acquire measured luminance levels at a measurement point of a display area for a plurality of test images displayed in the display area and estimate one or more luminance levels at one or more luminance estimation points of the display area using the measured luminance levels. The program further causes the processing unit to determine a correction parameter using the one or more estimated luminance levels.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
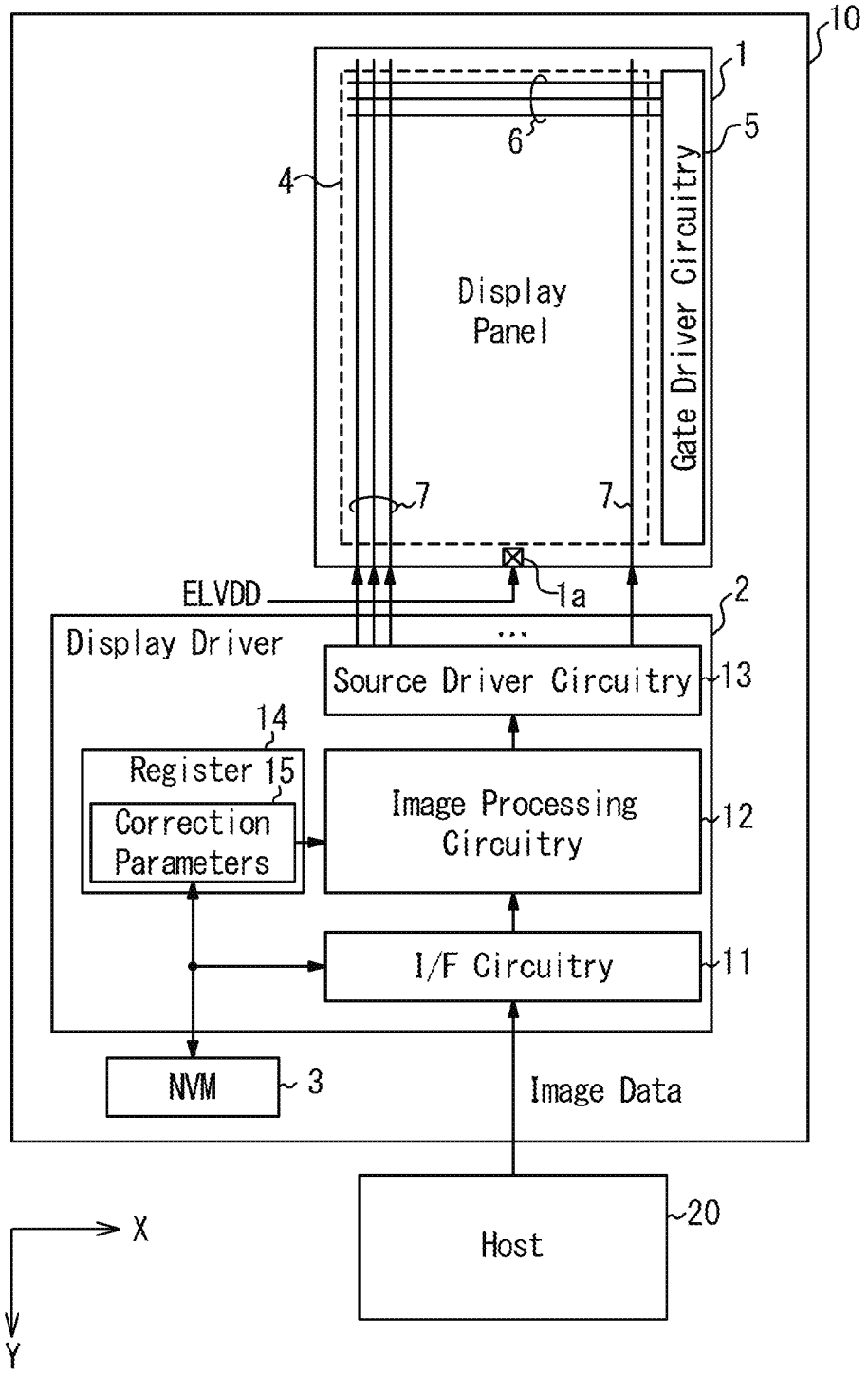
FIG. 1 illustrates an example configuration of a display module, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

FIG. 1 illustrates an example configuration of a display module, according to one or more embodiments. As illustrated in FIG. 1, a display module 10 is configured to display an image corresponding to image data received from a host 20. The display module 10 may comprise a display panel 1, a display driver 2, and a non-volatile memory 3. The display driver 2 may be configured to drive the display panel 1. The non-volatile memory 3 may be external to or integrated in the display driver 2.

The display panel 1 may comprise a display area 4 in which an image is displayed and gate driver circuitry 5. In one or more embodiments, gate lines 6, source lines 7, and display elements (not illustrated) are disposed in the display area 4. The gate lines 6 may be extended in a horizontal direction, and the source lines 7 may be extended in a vertical direction. In FIG. 1, the horizontal direction is illustrated as the X axis direction in an XY Cartesian coordinate system defined for the display panel 1, and the vertical direction is illustrated as the Y axis direction in the XY Cartesian coordinate system. The display elements may be disposed at respective intersections of the gate lines 6 and the source lines 7. The gate driver circuitry 5 may be configured to drive the gate lines 6 to select rows of display elements to be updated with drive voltages received from the display driver 2.

In one or more embodiments, the display panel 1 further comprises a power source terminal 1*a* configured to externally receive a power source voltage ELVDD. In various embodiments, the power source voltage ELVDD is delivered to the respective display elements from the power source terminal 1*a* via power source lines. The display panel 1 may comprise an organic light emitting diode (OLED) display panel. In such embodiments, the display elements each comprises a light emitting element configured to operate on the power source voltage ELVDD to emit light. In other embodiments, display panel 1 may be a different type of display panel in which the power source voltage is delivered to respective display elements, such as a micro light emitting diode (LED) display panel.

In one or more embodiments, each pixel disposed in the display area 4 comprises at least one display element configured to display red (R), at least one display element configured to display green (G), at least one display element configured to display blue (B). Each pixel may further comprise at least one additional display element configured to display a color other than red, green, and blue. The combination of the colors of the display elements in each pixel is not limited to that disclosed herein. For example, each pixel may further comprise a subpixel configured to display white or yellow. The display panel 1 may be configured to be adapted to subpixel rendering (SPR). In such embodiments, each pixel may comprise a plurality of display elements configured to display red, a plurality of display elements configured to display green, and/or a plurality of display elements configured to display blue.

In one or more embodiments, the display driver 2 comprises interface (I/F) circuitry 11, image processing circuitry 12, source driver circuitry 13, and register circuitry 14.

In one or more embodiments, the interface circuitry 11 is configured to forward image data received from the host 20 to the image processing circuitry 12. The interface circuitry 11 may be further configured to provide accesses to the register circuitry 14 and the non-volatile memory 3. In other embodiments, the interface circuitry 11 may be configured to process the image data received from the host 20 and send the processed image data to the image processing circuitry 12.

The image processing circuitry 12 may be configured to apply image processing to the image data received from the interface circuitry 11. In one or more embodiments, the image processing comprises IR drop correction to correct display mura that potentially results from a voltage drop over the power source lines that deliver the power source voltage ELVDD to the respective display elements from the power source terminal 1*a*. An effect of the voltage drop may depend on the position in the display panel 1 and a total current of the display panel 1. In such embodiments, the IR drop correction may be based on the position of a pixel of interest and the total current of the display panel 1. The total current may be a total sum of the currents that flow through all the display elements of the display panel 1. The total current of the display panel 1 may be calculated based on image data associated with one frame image displayed on the display panel 1. In one or more embodiments, the IR drop correction is performed to compensate the effect of the voltage drop.

In one or more embodiments, the correction parameters 15 used for the IR drop correction are stored in the register circuitry 14. The correction parameters 15 may represent a correlation of the position of the pixel of interest and the total current of the display panel 1 with a correction amount for the image data associated with the pixel of interest in the IR drop correction. The correction parameters 15 may be forwarded from the non-volatile memory 3 and stored in the register circuitry 14, for example, at startup or reset of the display module 10. In various embodiments, the image processing circuitry 12 is configured to receive the correction parameters 15 from the register circuitry 14 and perform the IR drop correction based on the received correction parameters 15.

In one or more embodiments, the source driver circuitry 13 is configured to drive the source lines 7 of the display panel 1 based on a processed image data generated through the image processing by the image processing circuitry 12. This achieves displaying a desired image on the display panel 1.

Properties of the display panel 1 and a non-illustrated power management IC (PMIC) configured to supply the power source voltage ELVDD to the display panel 1 may vary among display modules 10 due to manufacturing variations. To address such manufacturing variations, in one or more embodiments, each display module 10 is calibrated. In this calibration, correction parameters 15 may be suitably calculated for each display module 10.

Figure 2:
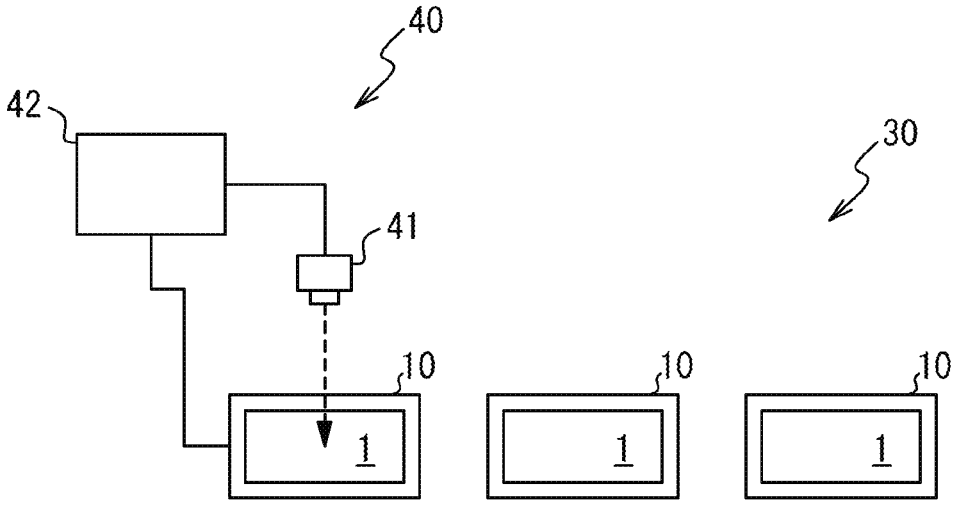
FIG. 2 illustrates an example configuration of a production line, according to one or more embodiments.

In one or more embodiments, as illustrated in FIG. 2, a production line 30 of display modules 10 comprises a calibration device 40 to achieve the calibration. The calibration device 40 may be configured to determine correction parameters 15 to be set for each display module 10 based on a measurement result with respect to each display module 10. The calibration device 40 comprises a luminance meter 41 and a main unit 42. The calibration device 40 is described in further details below.

Figure 3:
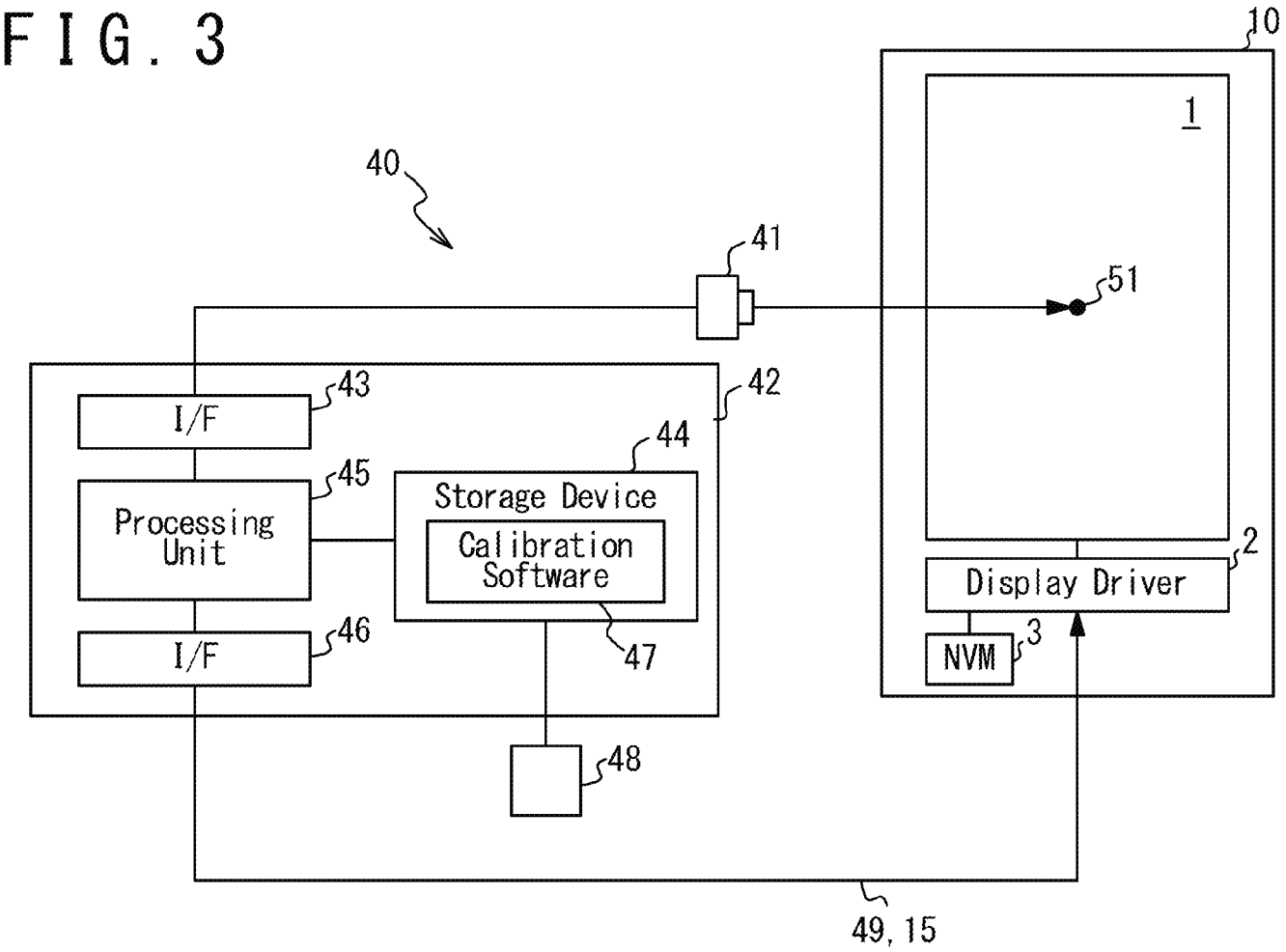
FIG. 3 illustrates an example configuration of a calibration device, according to one or more embodiments.

FIG. 3 illustrates an example configuration of the calibration device 40. In one or more embodiments, the calibration device 40 comprises a luminance meter 41 and a main unit 42. The luminance meter 41 may be configured to measure a luminance level of the display panel 1 of the display module 10. In one or more embodiments, the luminance meter 41 is configured to measure the luminance level and the color coordinates at a measurement point 51 on the display panel 1. The measurement point 51 may be predefined depending on the configuration of the luminance meter 41. The measurement point 51 may be determined suitably for acquiring one or more properties of the display panel 1, such as the luminance level and the color coordinates. The measurement point 51 may be located at the center of the display area 4.

The main unit 42 may be configured to determine the correction parameters 15, for example, through a software process. In some embodiments, the main unit 42 may be configured to calculate the correction parameters 15 using the luminance level and the color coordinates determined by the luminance meter 41. In one or more embodiments, the main unit 42 comprises interface circuitry 43, a storage device 44, a processing unit 45, and interface circuitry 46.

In one or more embodiments, the interface circuitry 43 is configured to acquire the luminance level at the measurement point 51 measured by the luminance meter 41. In embodiments where the luminance meter 41 is configured to generate a luminance value indicative of the measured luminance level at the measurement point 51, the interface circuitry 43 may be configured to receive the luminance value from the luminance meter 41. The interface circuitry 43 may be further configured to supply control data to the luminance meter 41 to control the same.

In one or more embodiments, the storage device 44 is configured to store various data used for determining the correction parameters 15. Examples of the various data may include the measured luminance level, parameters used in the calculation of the correction parameters 15 and intermediate data generated in the calculation. In various embodiments, calibration software 47 may be installed on the storage device 44, and the storage device 44 may be used as a non-transitory tangible storage medium to store the calibration software 47. The calibration software 47 may be provided for the calibration device 40 in the form of a computer program product recorded in a computer-readable recording medium 48, or in the form of a computer program product downloadable from a server.

In one or more embodiments, the processing unit 45 is configured to execute the calibration software 47 to determine the correction parameters 15. In various embodiments, the processing unit 45 is configured to generate the correction parameters 15 based on the luminance level of the display panel 1 measured by the luminance meter 41. The processing unit 45 may be configured to generate test image data 49 corresponding to one or more test images to be displayed on the display panel 1 when the luminance level of the display panel 1 is measured. The processing unit 45 may be further configured to supply the generated test image data 49 to the display driver 2. The processing unit 45 may be further configured to generate a control data to control the luminance meter 41. In such embodiments, the luminance meter 41 may be configured to measure the luminance level of the display panel 1 under control of the control data.

In one or more embodiments, the interface circuitry 46 is configured to supply the test image data 49 and the correction parameters 15 to the display module 10. The correction parameters 15 may be received by the display driver 2 and then written into the non-volatile memory 3 from the display driver 2.

The display area 4 of the display panel 1 may be segmented into a plurality of regions, and the measurement point 51 may be located in one of the plurality of regions. In various embodiments, luminance levels at the measurement point 51 are measured for a plurality of test images displayed in the display area 4, and the measured luminance levels are used to estimate luminance levels at one or more other locations, which may be hereinafter referred to as luminance estimation points. The luminance estimation points may be located in regions other than the region in which the measurement point 51 is located. In one or more embodiments, the correction parameters 15 are determined based on the estimated luminance levels at the luminance estimation points.

Figure 4:
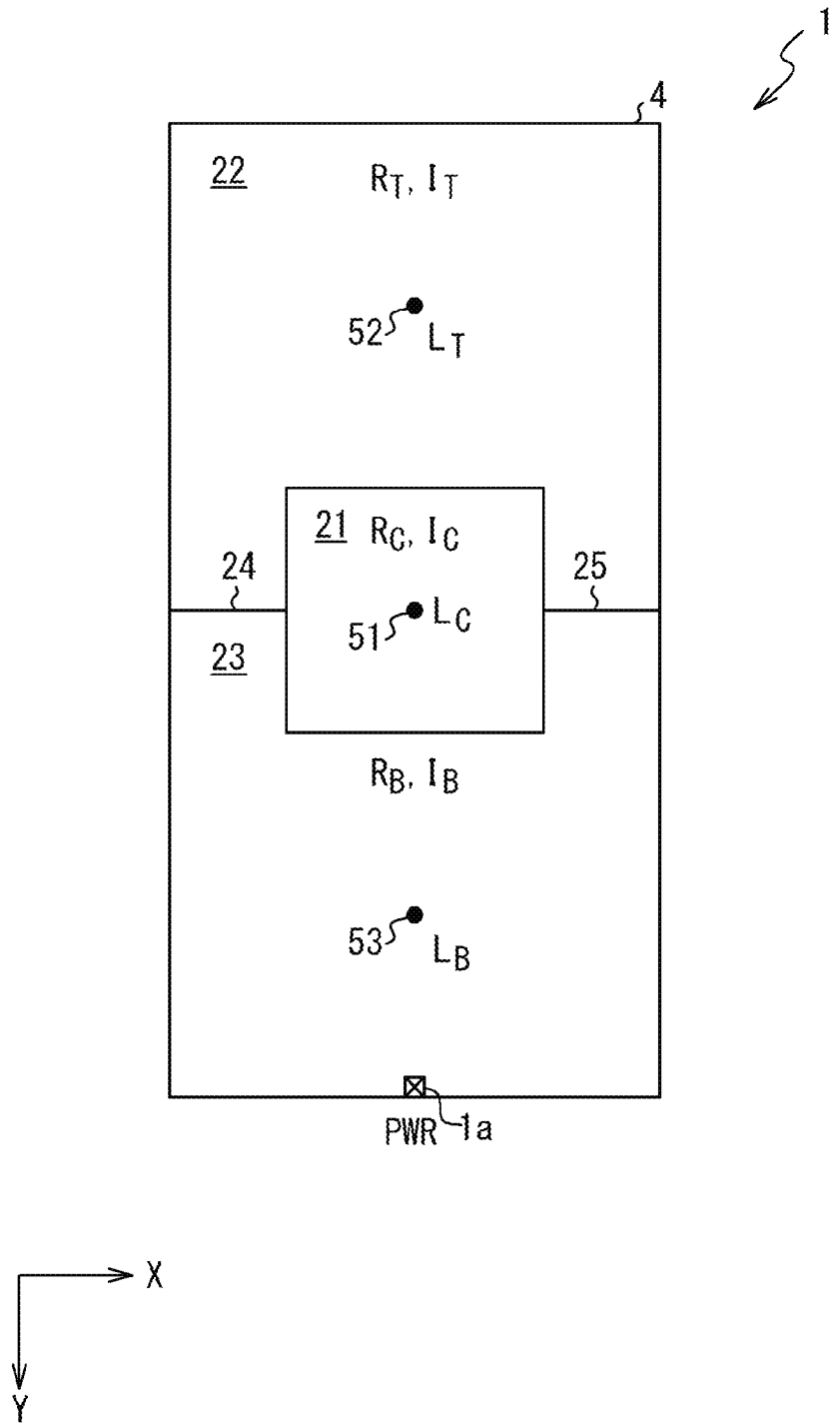
FIG. 4 illustrates an example arrangement of a center region, a top region and a bottom region, according to one or more embodiments.

FIG. 4 illustrates an example arrangement of various regions of the display area 4 of the display panel 1. In the embodiment illustrated, three regions, including a center region 21, a top region 22, and a bottom region 23 are defined in the display area 4. In other embodiments, the number of regions may be less or more than three. The regions may be pre-determined so that one of the regions includes the measurement point 51. In the embodiment illustrated in FIG. 4, the measurement point 51 is located in the center region 21. Various data associated with the regions may be used in determining the correction parameters 15. For example, the locations of the luminance estimation points in the respective regions may be used in the calculation of the correction parameters 15. In the example shown, the center region 21 may be located in the center of the display area 4. In one or more embodiments, the center region 21 is located between the top region 22 and the bottom region 23. The top region 22 and the bottom region 23 may be arrayed in the direction in which the source lines 7 are extended, which is illustrated as the Y axis direction in FIG. 4. In one or more embodiments, the bottom region 23 is located close to a power source terminal 1*a* and the top region 22 is located apart from the power source terminal 1*a*. In such embodiments, the effect of the voltage drop over the power source lines of the display panel 1 appears in the top region 22 more apparently than in the bottom region 23.

The top region 22 and the bottom region 23 may surround the center region 21. The top region 22 and the bottom region 23 may be in contact with each other at boundaries 24 and 25. The boundary 24 may extend in the +X direction from the edge of the display area 4 to reach the center region 21. The boundary 25 may be located opposite to the boundary 24 across the center region 21. The boundary 25 may extend in the −X direction from the edge of the display area 4 to reach the center region 21.

In one or more embodiments, one or more luminance estimation points are defined in regions other than the region in which the measurement point 51 is defined. In the embodiment illustrated, a luminance estimation point 52 is defined in the top region 22, and a luminance estimation point 53 is defined in the bottom region 23. The luminance estimation point 52 may be located at any location in the top region 22, and the luminance estimation point 52 may be located at any location in the bottom region 23. In various embodiments, luminance levels at the measurement point 51 are measured for a plurality of test images. The test images may be different from each other. The measured luminance levels are then used to estimate the luminance levels at the luminance estimation point 52 and/or the luminance estimation point 53 of an all-white image. The all-white image may be an image in which all the pixels in display area 4 are "white." In embodiments where an RGB color model is used, grayscale values for red (R), green (G), and blue (B) of a "white" pixel are the maximum grayscale value. In other embodiments, a "white" pixel may be a pixel for which a single grayscale value different from the minimum grayscale value is specified for red, green, and blue.

In one or more embodiments, the correction parameters 15 are determined based on the estimated luminance levels at the luminance estimation points 52 and/or 53. Using estimated luminance levels to determine the correction parameters 15 can eliminate the need for physically measuring luminance levels at multiple locations in the display area 4, and thereby enable a more efficient system. For example, a turn-around-time (TAT) to calculate the correction parameters 15 may be reduced, and the configuration of the luminance meter 41 may be simplified.

Figure 5:
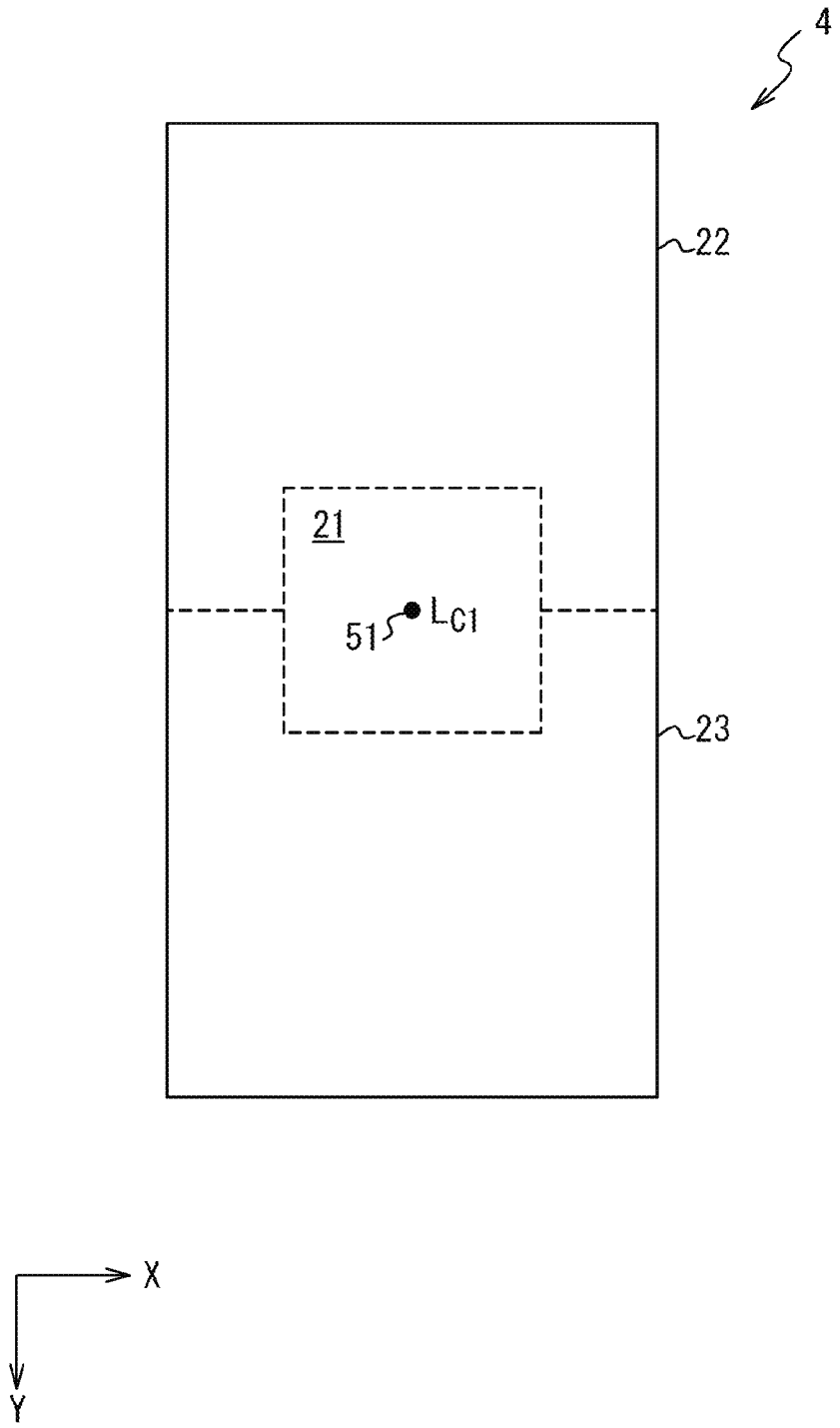
FIG. 5 illustrates an example of a first test image, according to one or more embodiments.
Figure 6:
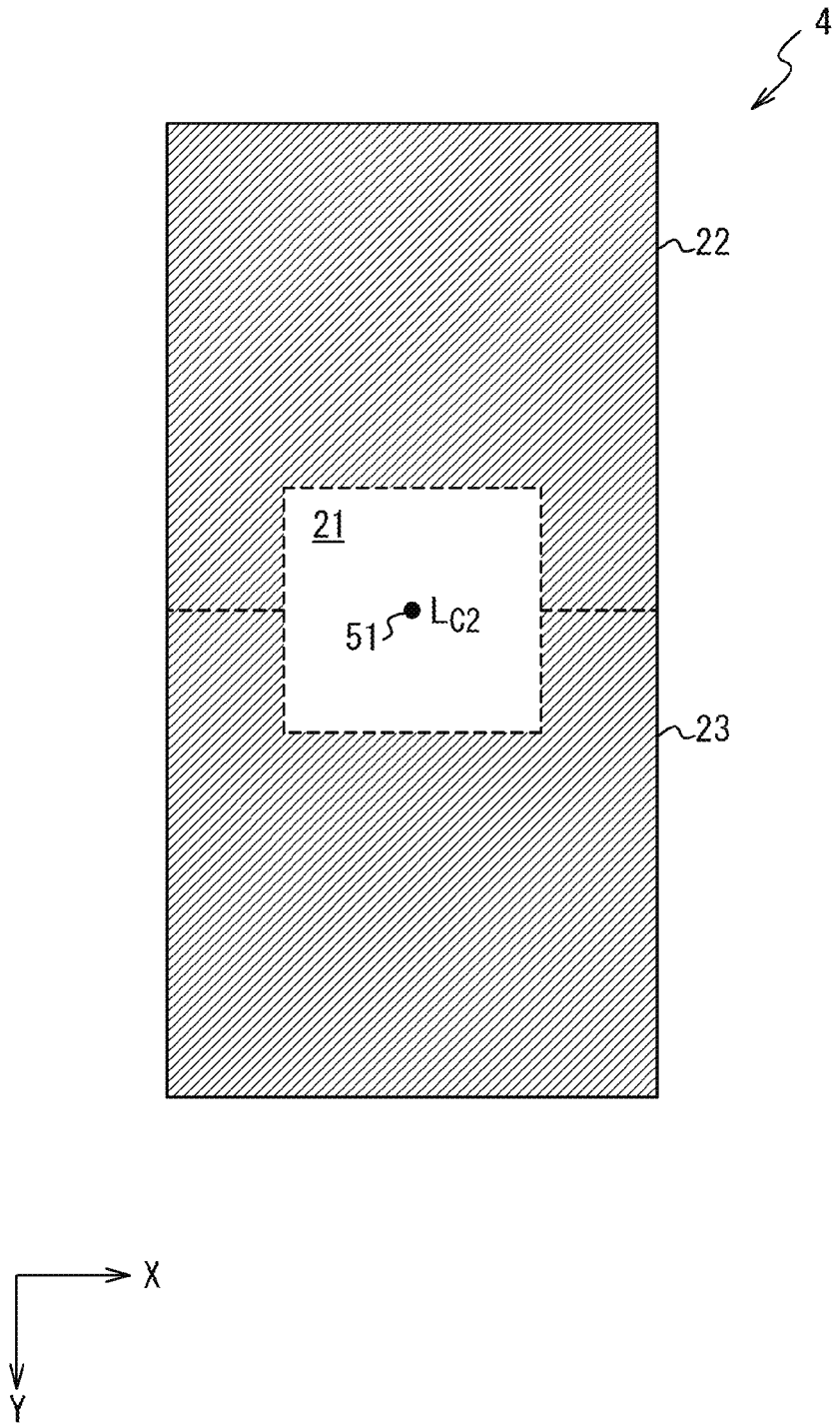
FIG. 6 illustrates an example of a second test image, according to one or more embodiments.
Figure 7:
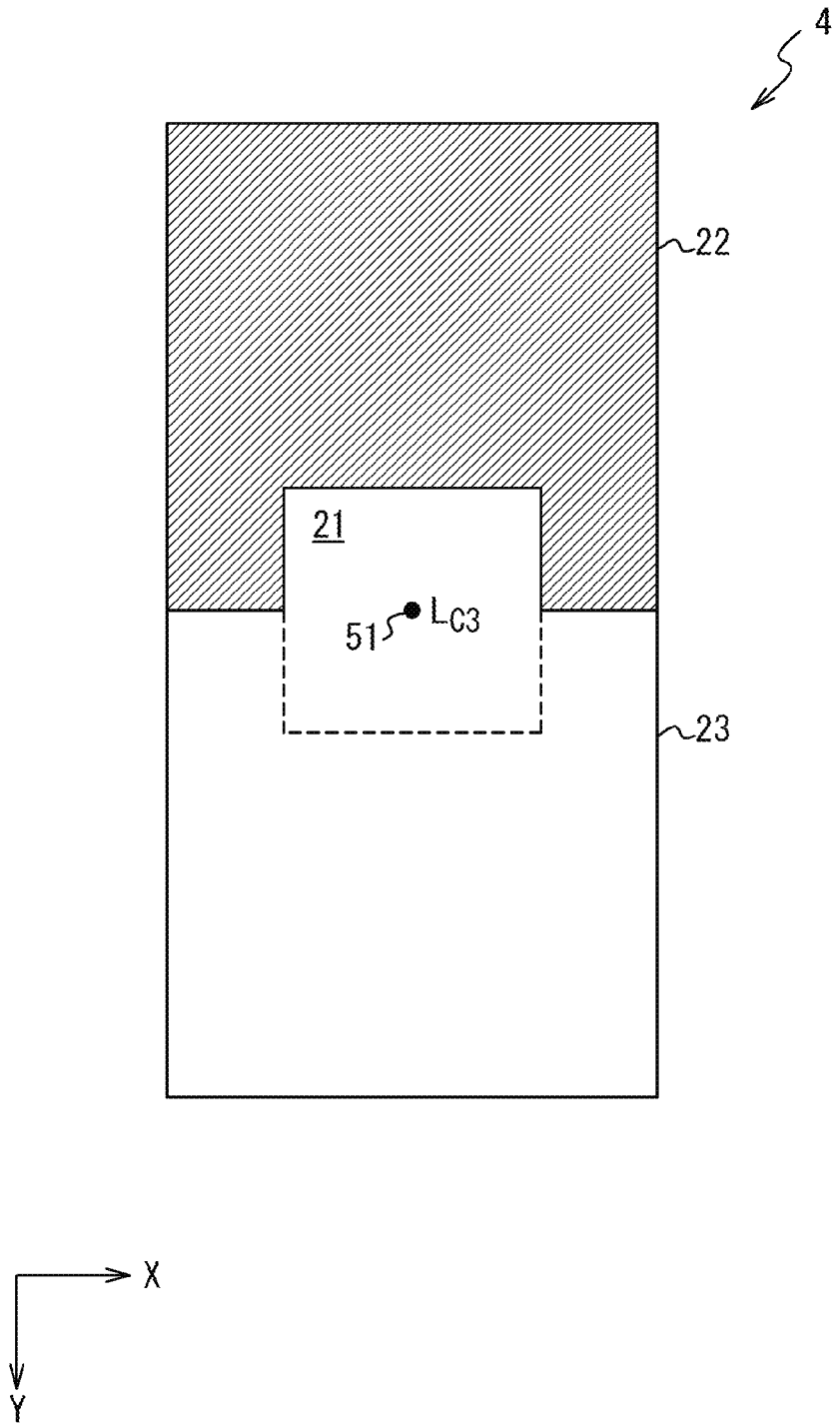
FIG. 7 illustrates an example of a third test image, according to one or more embodiments.
Figure 8:
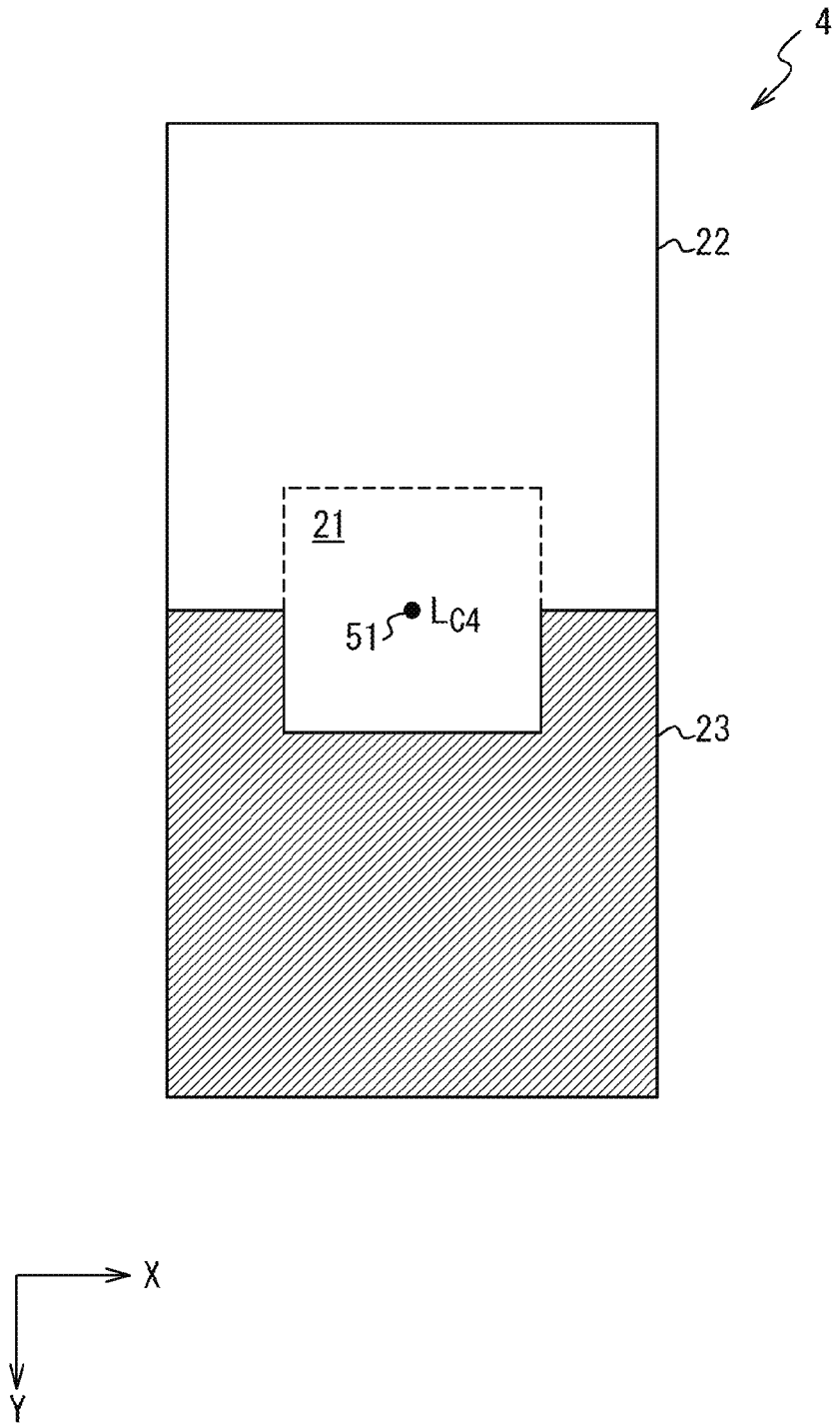
FIG. 8 illustrates an example of a fourth test image, according to one or more embodiments.

FIGS. 5-8 illustrate various test images that can be used to estimate luminance levels for determining the correction parameters 15. In one embodiment, test images used to calculate the correction parameters 15 may comprise first to fourth test images defined based on the center region 21, the top region 22, and the bottom region 23. FIG. 5 illustrates the first test image which may be an all-white image in which all the pixels in the display area 4 are "white." FIG. 6 illustrates the second test image which may be an image in which the pixels in the center region 21 are "white" and the pixels in the top region 22 and the bottom region 23 are "black". A "black" pixel may be a pixel having the minimum grayscale value specified for the display elements of all the colors. FIG. 7 illustrates the third test image which may be an image in which the pixels in the center region 21 and the bottom region 23 are "white" and the pixels in the top region 22 are "black." FIG. 8 illustrates the fourth test image which may be an image in which the pixels in the center region 21 and the top region 22 are "white" and the pixels in the bottom region 23 are "black". In one or more embodiments, the same grayscale value is specified for the "white" pixels in the second to fourth test images and the "white" pixels in the all-white image (or the first test image). For example, the same grayscale values different from the minimum grayscale value may be specified for the display elements of all the colors of the "white" pixels in the first to fourth test images and the all-white image. The same grayscale values may be the maximum grayscale value.

Figure 9:
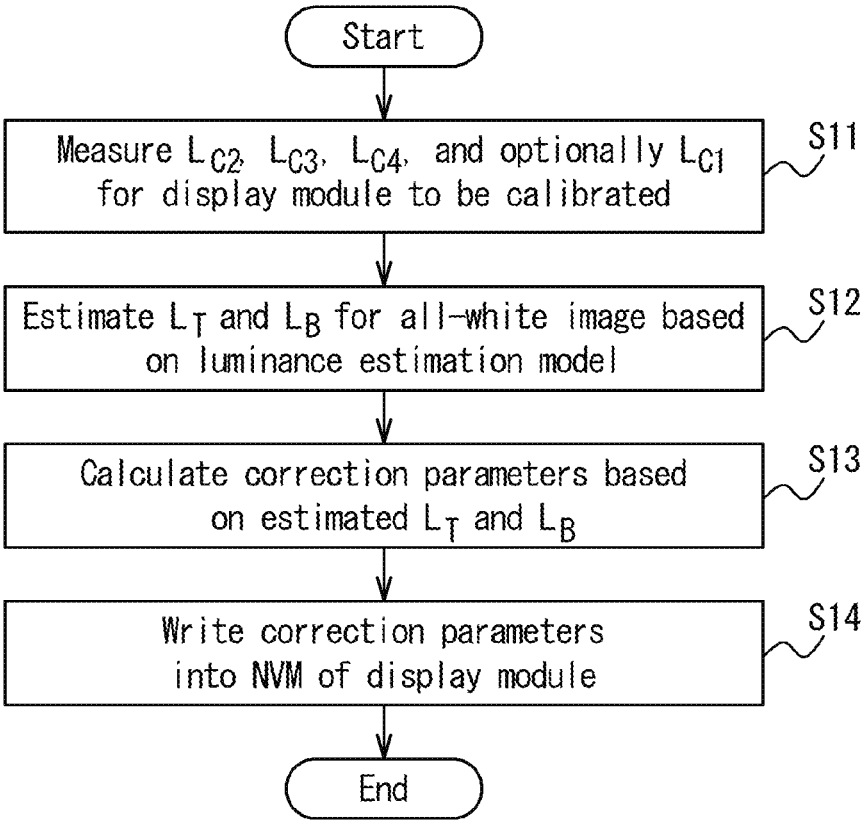
FIG. 9 illustrates an example calibration process, according to one or more embodiments.

FIG. 9 illustrates a calibration process for a display module. It should be noted that the order of the steps may be altered from the order illustrated. The process illustrated in FIG. 9 may be implemented by executing the calibration software 47 by the processing unit 45 of the main unit 42 of the calibration device 40.

In one or more embodiments, at step S11, luminance levels $L_{C2}$ to $L_{C4}$ at the measurement point 51 are measured for the second to fourth test images illustrated in FIGS. 6 to 8. In various embodiments, the luminance level $L_{C2}$ at the measurement point 51 is measured in a state in which the second test image is displayed in the display area 4 of the display panel 1; the luminance level $L_{C3}$ at the measurement point 51 is measured in a state in which the third test image is displayed in the display area 4; and the luminance level $L_{C4}$ at the measurement point 51 is measured in a state in which the fourth test image is displayed in the display area 4. Optionally, at step S11, a luminance level $L_{C1}$ at the measurement point 51 may be additionally measured in a state in which the first test image, that is, the all-white image, is displayed in the display area 4.

The processing unit 45 may be configured to generate test image data 49 corresponding to the first to fourth test images and supply the same to the display driver 2. In such embodiments, the display driver 2 may be configured to display the first to fourth test images in the display area 4 of the display panel 1 based on the test image data 49 supplied thereto.

In one or more embodiments, at step S12, the luminance levels $L_T$ and $L_B$ at the luminance estimation points 52 and 53 in a state in which the all-white image is displayed in the display area 4 are estimated based on a luminance estimation model. In one or more embodiments, the luminance levels $L_T$ and $L_B$ are estimated by applying the luminance estimation model to the luminance levels $L_{C2}$, $L_{C3}$, and $L_{C4}$ at the measurement point 51, which are measured at step S11. In one or more embodiments, the luminance levels $L_{C2}$, $L_{C3}$, and $L_{C4}$ comprise information of the effect of a voltage drop caused by currents flowing through the center region 21, the top region 22, and the bottom region 23, as is understood from the second to fourth test images illustrated in FIGS. 6 to 8. For example, the difference between the luminance levels $L_{C2}$ and $L_{C3}$ may comprise information of the effect of a voltage drop caused by the current flowing through the bottom region 23, and the difference between the luminance levels $L_{C2}$ and $L_{C4}$ may comprise information of the effect of a voltage drop caused by the current flowing through the top region 22. In one or more embodiments, the effect of a voltage drop caused by the current flowing through the center region 21 can be further extracted based on a comparison among the luminance levels $L_{C2}$, $L_{C3}$, and $L_{C4}$. In various embodiments, the luminance estimation model is established based on the above-described considerations.

In embodiments where the luminance level $L_{C1}$ at the measurement point 51 is not measured for the first test pattern (or the all-white image), the luminance estimation model may be designed to additionally estimate the luminance level $L_{C1}$ at the measurement point 51. In such embodiments, the luminance levels $L_T$ and $L_B$ may be estimated based on the estimated luminance level $L_{C1}$ and the measured luminance levels $L_{C2}$, $L_{C3}$, and $L_{C4}$. In embodiments where the luminance level $L_{C1}$ at the measurement point 51 is measured at step S11, the luminance levels $L_T$ and $L_B$ may be estimated by applying the luminance estimation model to the measured luminance levels $L_{C1}$, $L_{C2}$, $L_{C3}$, and $L_{C4}$.

Referring back to FIG. 4, the luminance estimation model may be based on circuit equations established among: a power source line resistance $R_C$ in the center region 21; a current $I_C$ flowing through the center region 21, a power source line resistance $R_T$ in the top region 22; a current $I_T$ flowing through the top region 22; a power source line resistance $R_B$ in the bottom region 23; and a current $I_B$ flowing through the bottom region 23. The luminance estimation model may be based on a first assumption that the luminance levels of the center region 21, the top region 22, and the bottom region 23 are proportional to the currents $I_C$, $I_T$, and $I_B$ that flow through the center region 21, the top region 22, and the bottom region 23, respectively. The luminance estimation model may be based on a second assumption that decreases in the luminance levels of the center region 21, the top region 22, and the bottom region 23 caused by the voltage drop over the power source lines are proportional to the voltages of the center region 21, the top region 22, and the bottom region 23. Parameters used in the luminance estimation model may be determined based on the circuit equations, the first assumption, and the second assumption.

Referring back to FIG. 9, in one or more embodiments, correction parameters 15 are calculated based on the estimated luminance levels $L_T$ and $L_B$ at the luminance estimation points 52 and 53 at step S13. The correction parameters 15 may be calculated further based on the measured or estimated luminance level $L_{C1}$ at the measurement point 51. The correction parameters 15 may be calculated to reduce, ideally eliminate, the difference among the luminance levels at the measurement point 51 and the luminance estimation points 52 and 53 in the state in which the all-white image is displayed in the display area 4.

In one or more embodiments, the thus-calculated correction parameters 15 are written into the non-volatile memory 3 of the display module 10 at step S14. The correction parameters 15 may be forwarded to the display driver 2 and then written into the non-volatile memory 3 from the display driver 2.

To improve the estimation accuracy of the luminance levels $L_T$ and $L_B$ at the luminance estimation points 52 and 53, the luminance levels $L_T$ and $L_B$ at the luminance estimation points 52 and 53 may be measured with respect to one or more display modules 10 in a state in which the all-white image is displayed in the display area 4, and the parameters of the luminance estimation model may be generated and/or modified based on the measured luminance levels $L_T$ and $L_B$. In one or more embodiments, the estimation of the luminance levels $L_T$ and $L_B$ and the calculation of the correction parameters 15 may be done for other display modules 10 based on the luminance estimation model with the parameters thus generated or modified.

In one or more embodiments, measurement-based values $L_T\hat{}$ and $L_B\hat{}$ used for the generation and/or modification of the parameters of the luminance estimation model may be generated based on the luminance levels $L_T$ and $L_B$ at the luminance estimation points 52 and 53 actually measured with respect to a plurality of display modules 10. In one or more embodiments, the luminance levels $L_T$ and $L_B$ at the luminance estimation points 52 and 53 are measured with respect to a plurality of display modules 10, and the average values of the measured luminance levels $L_T$ and $L_B$ may be used as the measurement-based values $L_T\hat{}$ and $L_B\hat{}$, respectively. In other embodiments, one typical display module 10 may be selected, and the luminance levels $L_T$ and $L_B$ at the luminance estimation points 52 and 53 measured with respect to the typical display module 10 may be used as the measurement-based values $L_T\hat{}$ and $L_B\hat{}$, respectively.

Figure 10:
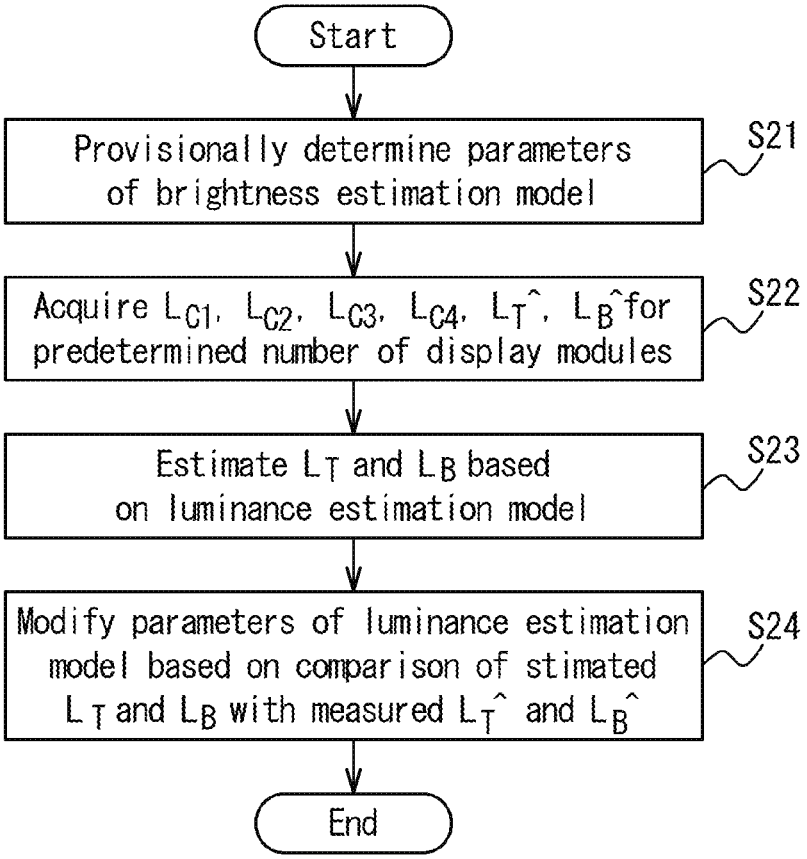
FIG. 10 illustrates an example process to modify parameters of a luminance estimation model, according to one or more embodiments.

FIG. 10 illustrates an example process for determining the parameters of the luminance estimation model, in one or more embodiments. It should be noted that the order of the steps may be altered from the order illustrated. The process illustrated in FIG. 10 may be implemented by executing the calibration software 47 by the processing unit 45 of the main unit 42 of the calibration device 40.

In one or more embodiments, at step S21, the parameters of the luminance estimation model are provisionally determined. At step S21, the parameters of the luminance estimation model may be determined based on available characteristic values of the display panel 1, for example. Examples of the characteristic values may include light emitting property of the display elements of the display panel 1, resistances of interconnections integrated in the display panel 1, and the voltage level of the power source voltage ELVDD and so forth.

In one or more embodiments, at step S22, the luminance levels $L_{C1}$, $L_{C2}$, $L_{C3}$, and $L_{C4}$ at the measurement point 51 and the measurement-based values $L_T\hat{}$ and $L_B\hat{}$ are acquired for one or more display modules 10. In various embodiments, the luminance level $L_{C2}$ at the measurement point 51 may be measured in the state in which the second test image is displayed in the display area 4. The luminance level $L_{C3}$ at the measurement point 51 may be measured in the state in which the third test image is displayed in the display area 4. The luminance level $L_{C4}$ at the measurement point 51 may be measured in the state in which the fourth test image is displayed in the display area 4. Further, the luminance level $L_{C1}$ at the measurement point 51 and the luminance levels $L_T$ and $L_B$ at the luminance estimation points 52 and 53 may be measured in a state in which the first test image, that is, the all-white image, is displayed in the display area 4. In such embodiments, the measurement-based values $L_T\hat{}$ and $L_B\hat{}$ used for the generation and/or modification of the parameters of the luminance estimation model may be generated based on the measured luminance levels $L_T$ and $L_B$ at the luminance estimation points 52 and 53.

In one or more embodiments, at step S23, the luminance levels $L_T$ and $L_B$ at the luminance estimation points 52 and 53 in the state in which the all-white image is displayed in the display area 4 are estimated based on the luminance estimation model. In various embodiments, the luminance levels $L_T$ and $L_B$ are estimated by applying the luminance estimation model to the luminance levels $L_{C1}$, $L_{C2}$, $L_{C3}$, and $L_{C4}$ at the measurement point 51 which are measured at step S22. In embodiments where the luminance estimation model does not rely on the measured luminance level $L_{C1}$ to estimate the luminance levels $L_T$ and $L_B$, the luminance levels $L_T$ and $L_B$ may be estimated by applying the luminance estimation model to the measured luminance levels $L_{C2}$, $L_{C3}$, and $L_{C4}$ at the measurement point 51.

In one or more embodiments, at step S24, the parameters of the luminance estimation model are modified based on a comparison of the estimated luminance levels $L_T$ and $L_B$ with the measurement-based values $L_T\hat{}$ and $L_B\hat{}$. In various embodiments, the parameters of the luminance estimation model may be modified to reduce the differences of the estimated luminance levels $L_T$ and $L_B$ from the measurement-based values $L_T\hat{}$ and $L_B\hat{}$, respectively. The above-described process to modify the parameters of the luminance estimation model may improve the estimation accuracy of the luminance levels $L_T$ and $L_B$.

Figure 11:
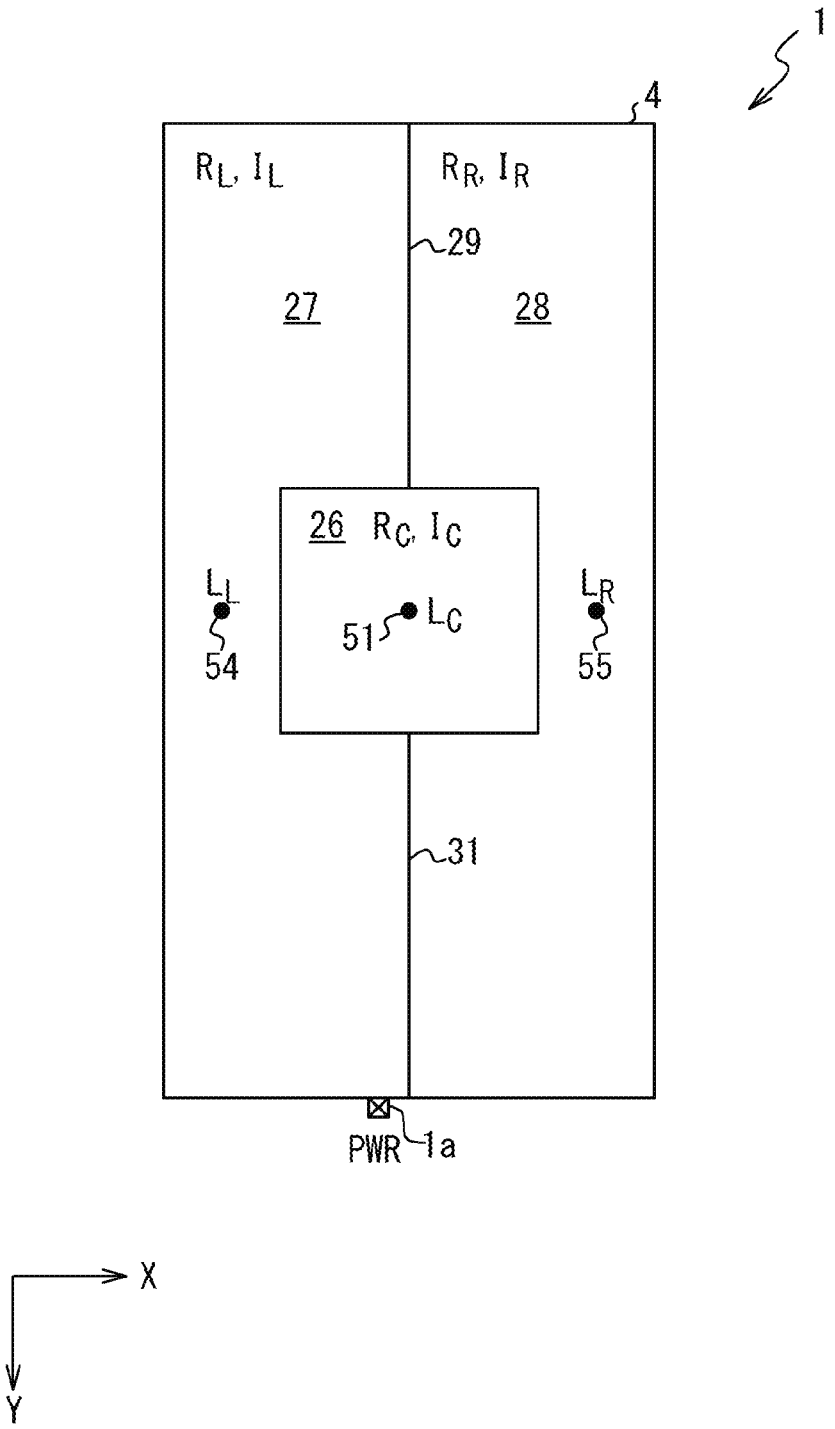
FIG. 11 illustrates an example arrangement of a center region, a left region and a right region, according to one or more embodiments.

The display area 4 of the display panel 1 may have different configurations of regions. For example, as illustrated in FIG. 11, the display area 4 may include a center region 26, a left region 27, and a right region 28. In the example shown, the center region 26 is located between the left region 27 and the right region 28, and the measurement point 51 is located in the center region 26. The left region 27 and the right region 28 may be arrayed in the direction in which the gate lines 6 are extended, which is illustrated as the X axis direction in FIG. 11.

The left region 27 and the right region 28 may surround the center region 26. The left region 27 and the right region 28 may be in contact with each other at boundaries 29 and 31. The boundary 29 may extend in the +Y direction from the edge of the display area 4 to reach the center region 26. The boundary 31 may be located opposite to the boundary 29 across the center region 26. The boundary 31 may extend in the −Y direction from the edge of the display area 4 to reach the center region 26.

In one or more embodiments, a luminance estimation point 54 is defined in the left region 27, and a luminance estimation point 55 is defined in the right region 28. In various embodiments, luminance levels at the measurement point 51 measured for a plurality of test images are used to estimate the luminance levels at the luminance estimation points 54 and 55 for an all-white image. In one or more embodiments, the correction parameters 15 are calculated based on the estimated luminance levels at the luminance estimation points 54 and 55.

Figure 12:
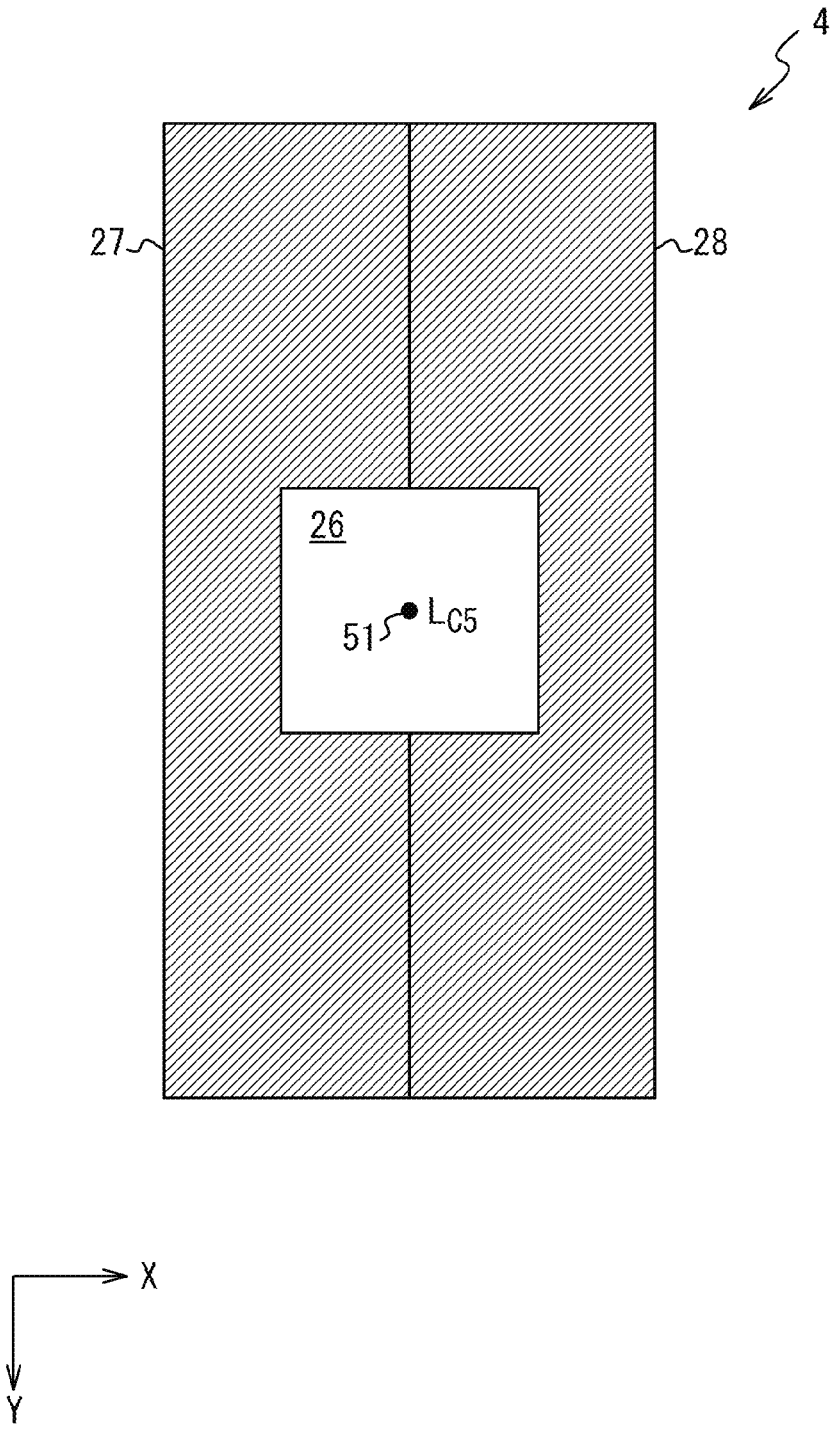
FIG. 12 illustrates an example of a fifth test image, according to one or more embodiments.
Figure 13:
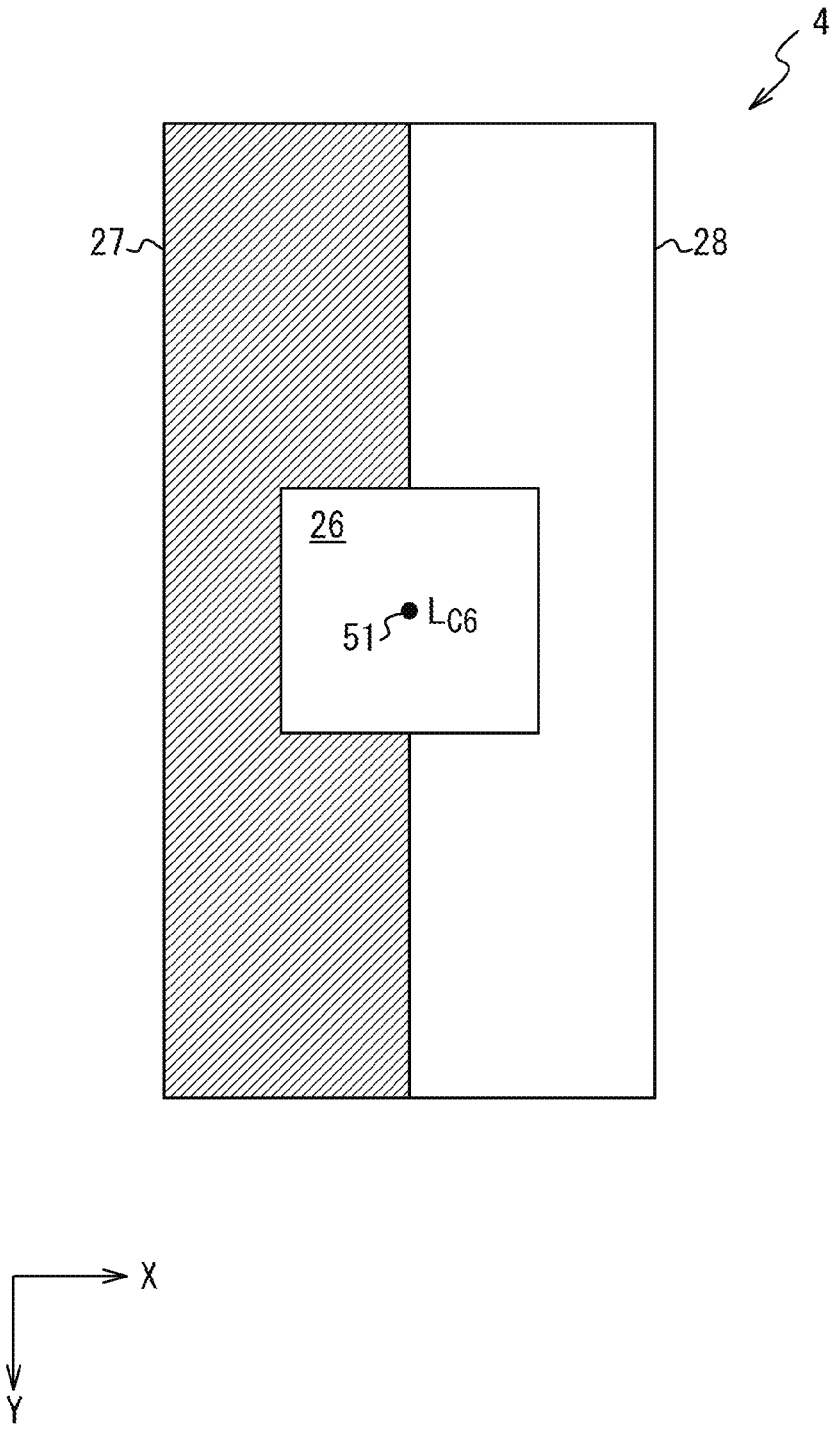
FIG. 13 illustrates an example of a sixth test image, according to one or more embodiments.
Figure 14:
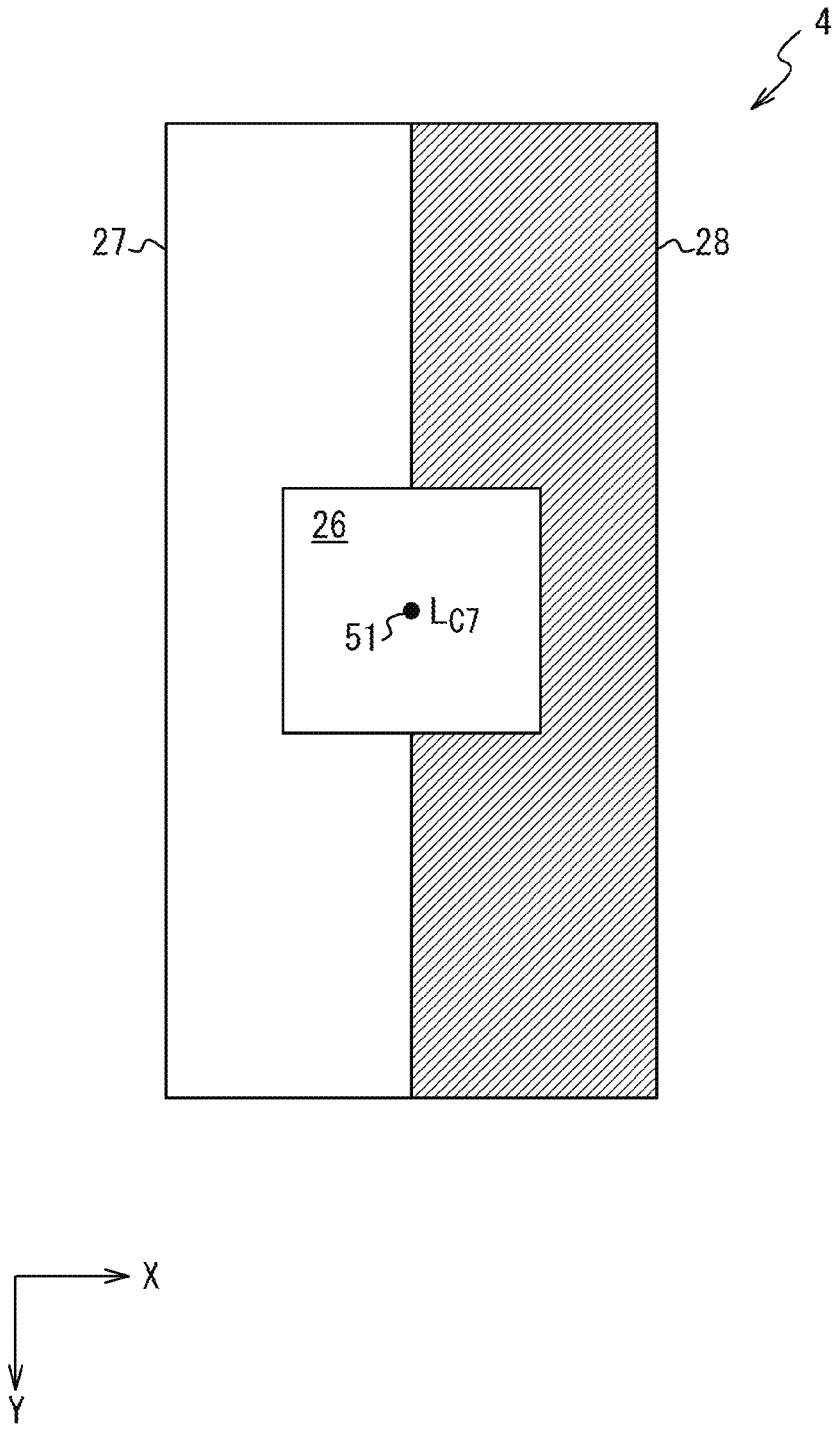
FIG. 14 illustrates an example of a seventh test image, according to one or more embodiments.

FIGS. 12-14 illustrate other test images that can be used to estimate luminance levels for determining the correction parameters 15. In one embodiment, test images used to determine the correction parameters 15 may comprise fifth to seventh test images defined based on the center region 26, the left region 27, and the right region 28. FIG. 12 illustrates the fifth test image which may be an image in which the pixels in the center region 26 are "white" and the pixels in the left region 27 and the right region 28 are "black". In embodiments where the center region 26 is identical to the center region 21 illustrated in FIG. 4, the fifth test image may be identical to the second test image illustrated in FIG. 6. FIG. 13 illustrates the sixth test image which may be an image in which the pixels in the center region 26 and the right region 28 are "white" and the pixels in the left region 27 are "black." FIG. 14 illustrates the seventh test image which may be an image in which the pixels in the center region 26 and the left region 27 are "white" and the pixels in the right region 28 are "black". The test images used to determine the correction parameters 15 may further comprise the first test image, that is, the all-white image.

A display module 10 may be calibrated by using the fifth to seventh test images illustrated in FIGS. 12-14 in place of the second to fourth test images illustrated in FIGS. 6-8. Also in such embodiments, the display module 10 may be calibrated through a process similar to that illustrated in FIG. 9. In one or more embodiments, luminance levels $L_{C5}$ to $L_{C7}$ at the measurement point 51 are measured for the fifth to seventh test images illustrated in FIGS. 12 to 14. Optionally, the luminance level $L_{C1}$ at the measurement point 51 may be additionally measured in a state in which the first test image, that is, the all-white image, is displayed in the display area 4. The luminance levels $L_L$ and $L_R$ at the luminance estimation points 54 and 55 in a state in which the all-white image is displayed in the display area 4 may be estimated by applying the luminance estimation model to the measured luminance levels $L_{C5}$, $L_{C6}$, and $L_{C7}$, and optionally $L_{C1}$ at the measurement point 51.

In embodiments where the luminance level $L_{C1}$ at the measurement point 51 is not measured for the all-white image, the luminance estimation model may be designed to additionally estimate the luminance level $L_{C1}$ at the measurement point 51. In such embodiments, the luminance levels $L_L$ and $L_R$ may be estimated based on the estimated luminance level $L_{C1}$ and the measured luminance levels $L_{C5}$, $L_{C6}$, and $L_{C7}$.

The correction parameters 15 may be then determined based on the estimated luminance levels $L_L$ and $L_R$ at the luminance estimation points 54 and 55. The correction parameters 15 may be determined further based on the measured or estimated luminance level $L_{C1}$ at the measurement point 51. The thus-calculated correction parameters 15 may be written into the non-volatile memory 3 of the display module 10.

In other embodiments, the luminance levels $L_{C2}$ to $L_{C7}$ may be measured for the second to seventh test images. In such embodiments, the measured luminance levels $L_{C2}$ to $L_{C7}$ may be then used to estimate the luminance levels $L_T$, $L_B$, $L_L$, and $L_R$ at the luminance estimation points 52, 53, 54, and 55 in the state where the all-white image is displayed. In such embodiments, the correction parameters 15 may be calculated based on the estimated luminance levels $L_T$, $L_B$, $L_L$, and $L_R$ at the luminance estimation points 52, 53, 54, and 55. In embodiments where the luminance level $L_{C1}$ at the measurement point 51 is measured, the correction parameters 15 may be calculated based on the measured luminance level $L_{C1}$ at the measurement point 51 and the estimated luminance levels $L_T$, $L_B$, $L_L$, and $L_R$ at the luminance estimation points 52, 53, 54, and 55.

Figure 15:
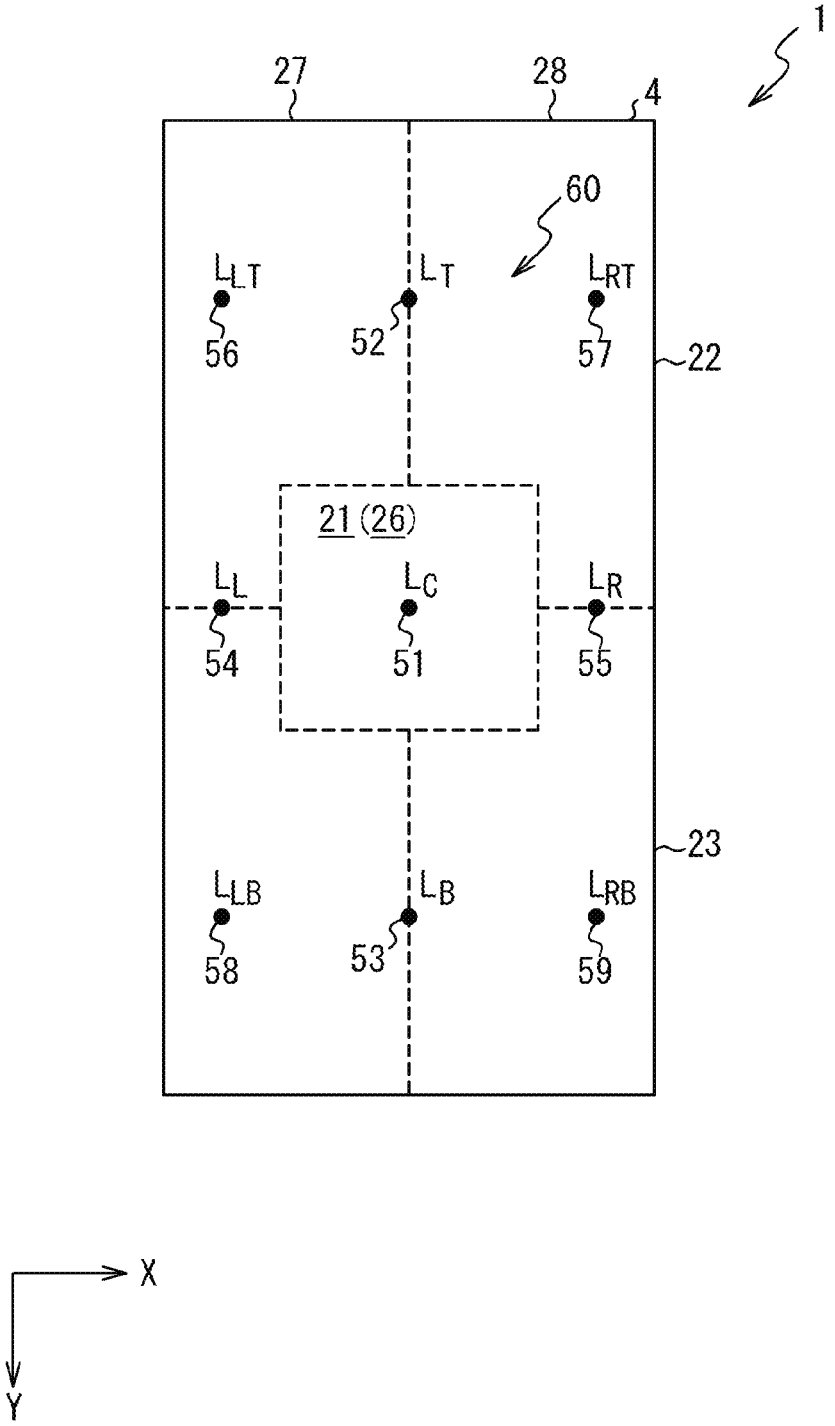
FIG. 15 illustrates an example arrangement of luminance estimation points, according to one or more embodiments.

Referring to FIG. 15, luminance levels $L_{LT}$, $L_{RT}$, $L_{LB}$, and $L_{RB}$ at luminance estimation points 56, 57, 58, and 59 in the state in which the all-white image is displayed may be additionally estimated based on the measured luminance levels $L_{C2}$ to $L_{C7}$ at the measurement point 51. The luminance estimation point 56 may be located in a region in which the top region 22 and the left region 27 overlap each other. The luminance estimation point 57 may be located in a region in which the top region 22 and the right region 28 overlap each other. The luminance estimation point 58 may be located in a region in which the bottom region 23 and the left region 27 overlap each other. The luminance estimation point 59 may be located in a region in which the bottom region 23 and the right region 28 overlap each other. In various embodiments, the luminance estimation point 56 is located at the top left corner of an array 60 in which the measurement point 51 and the luminance estimation points 52 to 59 are arrayed, and the luminance estimation point 57 is located at the top right corner of the array 60. In various embodiments, the luminance estimation point 58 is located at the bottom left corner of the array 60, and the luminance estimation point 59 is located at the bottom right corner of the array 60. The luminance estimation point 56 may be positioned in the −X direction with respect to the luminance estimation point 52 and in the −Y direction with respect to the luminance estimation point 54. The luminance estimation point 57 may be positioned in the +X direction with respect to the luminance estimation point 52 and in the −Y direction with respect to the luminance estimation point 55. The luminance estimation point 58 may be positioned in the −X direction with respect to the luminance estimation point 53 and in the +Y direction with respect to the luminance estimation point 54. The luminance estimation point 59 may be positioned in the +X direction with respect to the luminance estimation point 53 and in the +Y direction with respect to the luminance estimation point 55. The luminance levels $L_{LT}$, $L_{RT}$, $L_{LB}$, and $L_{RB}$ at the luminance estimation points 56, 57, 58, and 59 may be estimated based on a luminance estimation model.

In embodiments where the luminance level $L_{C1}$ at the measurement point 51 is measured in the state in which the all-white image is displayed on the display panel 1, the luminance levels $L_{LT}$, $L_{RT}$, $L_{LB}$, and $L_{RB}$ at the luminance estimation points 56, 57, 58, and 59 may be estimated based on the measured luminance level $L_{C1}$ in addition to the measured luminance levels $L_{C2}$ to $L_{C7}$. In embodiments where the second test image illustrated in FIG. 6 is identical to the fifth test image illustrated in FIG. 12, that is, the center region 21 illustrated in FIG. 5 is identical to the center region 26 illustrated in FIG. 11, it is unnecessary to duplicately measure the luminance levels $L_{C2}$ and $L_{C5}$.

In one or more embodiments, the correction parameters 15 may be calculated based on the estimated luminance levels $L_T$, $L_B$, $L_L$, $L_R$, $L_{LT}$, $L_{RT}$, $L_{LB}$, and $L_{RB}$ at the luminance estimation points 52 to 59. In embodiments where the luminance level $L_{C1}$ at the measurement point 51 is measured in the state in which the all-white image is displayed in the display area 4, the correction parameters 15 may be calculated further based on the measured luminance level $L_{C1}$ at the measurement point 51. The correction parameters 15 may be calculated to reduce, ideally eliminate, the difference among the luminance levels at the measurement point 51 and the luminance estimation points 52 to 59 in the state in which an all-white image is displayed in the display area 4. The calculation of the correction parameters 15 based on the estimated luminance levels $L_T$, $L_B$, $L_L$, $L_R$, $L_{LT}$, $L_{RT}$, $L_{LB}$, and $L_{RB}$, and if measured the measured luminance level $L_{C1}$ may offer a proper IR drop correction for the entire display panel 1.

While various embodiments have been specifically described in the above, a person skilled in the art would appreciate that the technologies disclosed herein may be implemented with various modifications.

What is claimed is:

1. A method comprising:

acquiring measured luminance levels at a measurement point of a display area for a plurality of test images displayed in the display area, wherein:

the display area comprises a center region between a first region and a second region, the first region and the second region are arrayed in a first direction corresponding to a direction in which a power source line disposed in the display area is extended, and the measurement point is located in the center region, and the plurality of test images comprises:

a first test image in which pixels in the center region, the first region and the second region are white, a second test image in which pixels in the center region are white and pixels in the first region and the second region are black, a third test image in which pixels in the center region and the second region are white and pixels in the first region are black, a fourth test image in which pixels in the center region and the first region are white and pixels in the second region are black;

estimating a first estimated luminance level at a first luminance estimation point for a state in which an all-white image is displayed in the display area, the first luminance estimation point being located in the first region;

estimating a second estimated luminance level at a second luminance estimation point for the state in which the all-white image is displayed in the display area, the second luminance estimation point being located in the second region; and determining a correction parameter using the first or the second estimated luminance levels.

2. The method of claim 1, further comprising correcting IR drops using the correction parameter.

3. The method of claim 1, wherein the plurality of test images is determined based on the number of the regions in the display area.

4. A method comprising:

acquiring a measured luminance level at a measurement point of a display area for a plurality of test images displayed in the display area, wherein:

the display area comprises a center region between a first region and a second region, the first region and the second region are arrayed in a first direction corresponding to a direction in which a power source line disposed in the display area is extended, and the measurement point is located in the center region, and the plurality of test images comprises:

a first test image in which pixels in the center region, the first region and the second region are white, a second test image in which pixels in the center region are white and pixels in the first region and the second region are black, a third test image in which pixels in the center region and the second region are white and pixels in the first region are black, a fourth test image in which pixels in the center region and the first region are white and pixels in the second region are black;

estimating one or more luminance levels at one or more luminance estimation points of the display area using the measured luminance level; and determining a correction parameter using the first or the second estimated luminance levels, acquiring a second measured luminance level at the measurement point for a state in which the second test image is displayed in the display area;

acquiring a third measured luminance level at the measurement point for a state in which the third test image is displayed in the display area; and acquiring a fourth measured luminance level at the measurement point for a state in which the fourth test image is displayed in the display area.

5. A method comprising:

acquiring a measured luminance level at a measurement point of a display area for a plurality of test images displayed in the display area, wherein:

the display area comprises a center region between a first region and a second region, the first region and the second region are arrayed in a first direction corresponding to a direction in which a power source line disposed in the display area is extended, and the measurement point is located in the center region, and the plurality of test images comprises:

a first test image in which pixels in the center region, the first region and the second region are white, a second test image in which pixels in the center region are white and pixels in the first region and the second region are black, a third test image in which pixels in the center region and the second region are white and pixels in the first region are black, a fourth test image in which pixels in the center region and the first region are white and pixels in the second region are black;

estimating one or more luminance levels at one or more luminance estimation points of the display area using the measured luminance level; and determining a correction parameter using the first or the second estimated luminance levels, wherein the plurality of test images further comprises:

a fifth test image in which pixels in the center region are white and pixels in a third region and a fourth region are black, the center region being located between the third region and the fourth region;

a sixth test image in which pixels in the center region and the third region are white and pixels in the fourth region are black; and a seventh test image in which pixels in the center region and the fourth region are white and pixels in the third region are black, wherein the third region and the fourth region are arrayed in a second direction orthogonal to the first direction.

6. A calibration device, comprising:

a luminance meter configured to measure luminance levels at a measurement point of a display area for a plurality of test images displayed in the display area, wherein:

the display area comprises a center region between a first region and a second region, the first region and the second region are arrayed in a first direction corresponding to a direction in which a power source line disposed in the display area is extended, and the measurement point is located in the center region, and the plurality of test images comprises:

a first test image in which pixels in the center region, the first region and the second region are white, a second test image in which pixels in the center region are white and pixels in the first region and the second region are black, a third test image in which pixels in the center region and the second region are white and pixels in the first region are black, a fourth test image in which pixels in the center region and the first region are white and pixels in the second region are black;

a processing unit configured to:

estimate a first estimated luminance level at a first luminance estimation point for a state in which an all-white image is displayed in the display area, the first luminance estimation point being located in the first region;

estimate a second estimated luminance level at a second luminance estimation point of the one or more luminance estimation points for the state in which the all-white image is displayed in the display area, the second luminance estimation point being located in the second region; and determine a correction parameter based on the one or more estimated luminance levels.

7. The calibration device of claim 6, wherein the processing unit is further configured to correct IR drops using the correction parameter.

8. A non-transitory tangible storage medium storing a program which when executed causes a processing unit to:

acquire measured luminance levels at a measurement point of a display area for a plurality of test images displayed in the display area, wherein:

the display area comprises a center region between a first region and a second region, the first region and the second region are arrayed in a first direction corresponding to a direction in which a power source line disposed in the display area is extended, and the measurement point is located in the center region, and the plurality of test images comprises:

a first test image in which pixels in the center region, the first region and the second region are white, a second test image in which pixels in the center region are white and pixels in the first region and the second region are black, a third test image in which pixels in the center region and the second region are white and pixels in the first region are black, a fourth test image in which pixels in the center region and the first region are white and pixels in the second region are black;

estimate a first estimated luminance level at a first luminance estimation point for a state in which an all-white image is displayed in the display area, the first luminance estimation point being located in the first region;

estimate a second estimated luminance level at a second luminance estimation point of the one or more luminance estimation points for the state in which the all-white image is displayed in the display area, the second luminance estimation point being located in the second region; and determine a correction parameter using the one or more estimated luminance levels.

9. The non-transitory tangible storage medium of claim 8, wherein the processing unit corrects IR drops using the correction parameter.

* * * * *